US006822147B2

(12) United States Patent
McPherson

(10) Patent No.: US 6,822,147 B2
(45) Date of Patent: Nov. 23, 2004

(54) ARRANGEMENT OF A SOUND HOLE AND CONSTRUCTION OF A SOUND BOARD IN AN ACOUSTIC GUITAR

(76) Inventor: Mathew McPherson, 19055 Incline Rd., Norwalk, WI (US) 54648

( * ) Notice: Subject to any disclaimer, the term of this patent is extended or adjusted under 35 U.S.C. 154(b) by 719 days.

(21) Appl. No.: 09/567,145

(22) Filed: May 9, 2000

(65) Prior Publication Data

US 2002/0043146 A1 Apr. 18, 2002

Related U.S. Application Data

(63) Continuation of application No. 09/005,104, filed on Jan. 9, 1998, now Pat. No. 6,060,650.

(51) Int. Cl.[7] ..... G10D 3/00

(52) U.S. Cl. ..... 84/291; 84/290; 84/267; 84/294; 84/192; 84/193; 84/194

(58) Field of Search ..... 84/291, 290, 267, 84/294, 192, 193, 194

(56) References Cited

U.S. PATENT DOCUMENTS

| | | | | |
|---|---|---|---|---|
| 168,665 A | * | 10/1875 | Oehrleim | 84/291 |
| 2,523,963 A | | 9/1950 | Mitchell | 84/267 |
| 3,539,699 A | | 11/1970 | Johnson | 84/1.16 |
| 3,869,954 A | | 3/1975 | Ito | 84/291 |
| 4,056,034 A | | 11/1977 | Kaman | 84/267 |
| 4,090,427 A | | 5/1978 | Kaman | 84/291 |
| 4,178,827 A | | 12/1979 | Mallory | 84/291 |
| 4,317,402 A | | 3/1982 | McPherson, Sr. | 84/291 |
| D270,735 S | | 9/1983 | McPherson, Sr. | D17/20 |
| 4,467,692 A | | 8/1984 | Egan | 84/291 |
| 4,941,389 A | | 7/1990 | Wendler | 84/727 |
| 5,171,926 A | | 12/1992 | Besnainou et al. | 84/275 |

FOREIGN PATENT DOCUMENTS

| | | | |
|---|---|---|---|
| FR | 2529363 | | 6/1982 |
| SU | 1660-031 | * | 6/1991 |

OTHER PUBLICATIONS

Supro, Valco Guitars, Inc. Chicago 60635, Dec. 7, 1964.*
"Steel–String Guitar Construction" by Irving Sloane, E.P. Dutton & Co., Inc., New York, 1975, pp. 19.

* cited by examiner

*Primary Examiner*—Shih-Yung Hsieh
(74) *Attorney, Agent, or Firm*—Vidas, Arrett & Steinkraus PA

(57) ABSTRACT

An acoustic guitar having a single sound hole placed on the perimeter of the sound board for enhancing its sound generating characteristics and a novel sound board design.

17 Claims, 5 Drawing Sheets

ARRANGEMENT OF A SOUND HOLE AND CONSTRUCTION OF A SOUND BOARD IN AN ACOUSTIC GUITAR

RELATION TO OTHER APPLICATIONS

The present application is a continuation application of U.S. patent application Ser. No. 09/005,104, filed Jan. 9, 1998, now U.S. Pat. No. 6,060,650 which is herein incorporated by reference in its entirety.

BACKGROUND OF THE INVENTION

Acoustic guitars are constructed so as to amplify the sound wave produced by the vibration of the strings, via a resonance body having a sound board. The sound wave created by the vibrating strings is introduced into the resonance body through the bridge provided on the sound board. Inside the resonance body, the sound wave is resounded and amplified within the resonance body.

Acoustic guitars typically include a round sound hole located in the sound board at a centered position in the waist and upper bout of the guitar body and underneath the strings of the instrument. The present invention has shown that this is not the optimum location for the sound hole in that the instrument is unable to deliver the clean, brilliant sound for the body sound box that is put into it in the form of vibration tones put in action by the bridge.

The input sound to the guitar body sound box can be heard by laying one's ear on the guitar sound board near the bridge. When this is done, one hears the clean, brilliant input sound. However, without one's ear on the guitar sound board, the normally heard output sound of the guitar is heard as a muddy sound, when compared to the input sound heard with the ear against the guitar.

To improve the sound quality of the guitar, attempts have been made to rearrange the sound hole in particular locations. An attempt has also been made to have a plurality of sound holes strategically located on the face of the guitar. Patents which disclose an irregular location of the sound hole, and are incorporated herein by reference in their entirety, include:

| | |
|---|---|
| U.S. Pat. No. 2,523,963 | U.S. Pat. No. 4,090,427 |
| U.S. Pat. No. 3,539,699 | U.S. Pat. No. 4,317,402 |
| U.S. Pat. No. 3,869,954 | French Patent No. 2529363 |
| U.S. Pat. No. 4,056,034 | |

The present invention is an improvement over the above-mentioned prior art in that it more effectively utilizes as much of the sound board as possible by positioning a single sound hole, or zone, in a specific location to optimize the vibration of the sound board.

The art referred to and/or described above is not intended to constitute an admission that any patent, publication or other information referred to herein is "prior art" with respect to this invention. In addition, this section should not be construed to mean that a search has been made or that no other pertinent information as defined in 37 C.F.R. §1.56(a) exists.

SUMMARY OF THE INVENTION

In accordance with the invention, a single sound hole, or zone, is located on the face of the sound board immediately adjacent to the upper side panel of the guitar extending approximately from the upper end of the bridge to the upper waist portion. Separately or in combination with the novel positioning of the sound hole, a sound board comprising one or more, most preferably no more than two, layers of wood glued together, wherein the grain direction of the layers are perpendicularly situated.

The practice of the present invention achieves several objectives and advantages. The objectives and advantages are: a guitar of improved design which makes the normally heard out-out sound produced by the guitar for normal listening conditions more like that which is heard with one's ear against the guitar. The present invention more effectively utilizes as much of the effective part of the sound board as possible by positioning a single sound hole, or a plurality of holes, in a specific location, or zone, to optimize the vibration of the sound board.

DESCRIPTION OF THE PREFERRED EMBODIMENT

Figure 1:
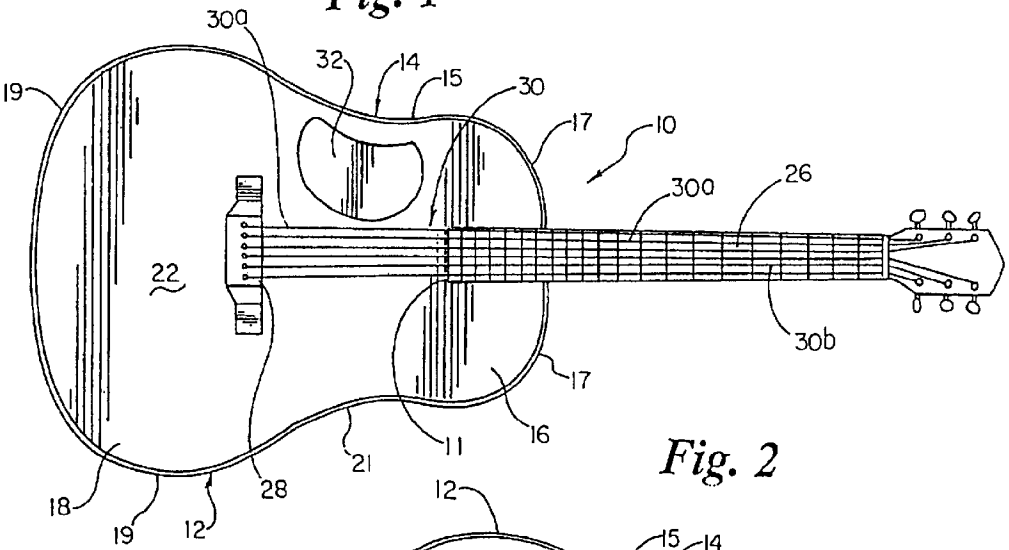
FIG. 1 is a face view of an acoustic guitar according to the invention.

Referring to FIG. 1, this invention relates to an improvement in acoustic guitars such as the one generally indicated at 10 having a guitar body or sound box 12. Hollow body 12 has a waist generally indicated at 14 which identifies the narrowest portion or mid-section of the guitar. The portion of the guitar body above waist 14 is known as the upper bout and is generally designated in the Figure at 16. The portion of the guitar body below waist 14 is generally known as the lower bout and is generally designated in the Figure at 18.

The top, 22, seen in FIG. 1 of guitar hollow body 12 is known as the sound board. The sound board 22, at its periphery, defines the edges of the upper bout 17, the lower bout 19 and the edges of upper 15 and lower 21 waist portions. The edges of the sound board are connected to side panels and in turn the rear panel to form the hollow body as is typical of guitars. As is conventional in guitars, a neck 26 is attached to hollow body 12 to extend over sound board 22 as shown. A bridge 28 is also anchored to sound board 22 to transfer vibrations into the sound board. Strings generally designated 30, including bass strings 30*a*, which are closest to the upper edge 15 of the waist, and treble strings 30*b*, which are closest to the lower edge 21 of the waist, extend along neck 26 and are received by bridge 28, thereby supporting strings 30 over sound board 22. Strings 30 are attached at the distal end of the neck 26 in any conventional manner known in the art, preferably in such a way to allow for tension adjustment of the strings. The strings may be steel, gut or any other type string ordinarily used with an acoustic guitar.

Figure 2:
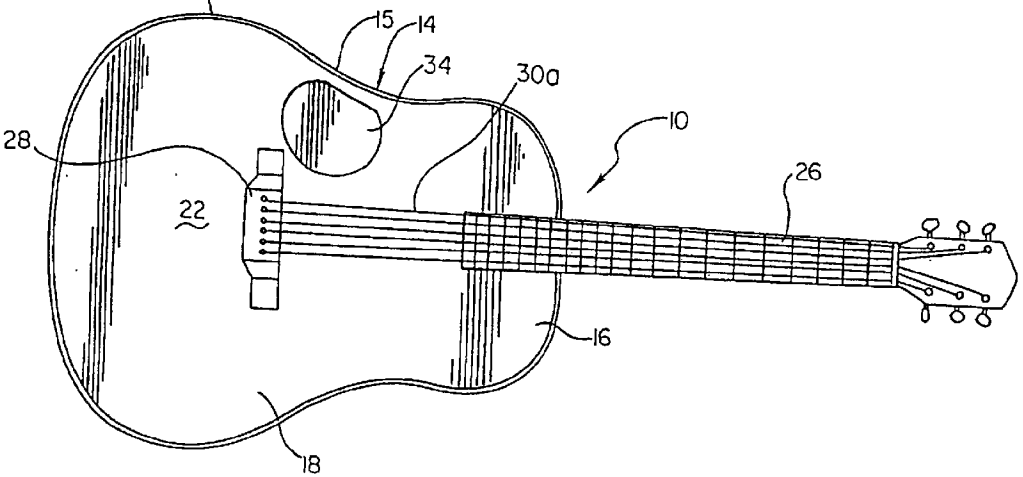
FIG. 2 shows a face view of an alternative manifestation of the invention.

According to the invention and as seen in FIGS. 1–2, a sound hole 32 is formed in the sound board 22. The location of this hole is, in large part, responsible for the improved sound produced by the guitar of this invention. Preferably, the hole is generally oval or kidney in shape in the preferred forms of this inventions as shown in FIGS. 1 and 2. Any shapes however, particularly an oblong one, may be utilized according to the invention to improve the sound produced by the guitar.

As can been seen in FIGS. 1 and 2, the hole, 32 and 34, is preferably positioned between the upper 16 and lower 18 bouts and between the edge 15 of the waist 14 and the bass strings 30*a*. The zone 32 and 34 is positioned distally from the bridge 28 and proximally from the proximal end of the neck 11. In the preferred form of the invention as depicted in FIG. 2, the hole will be located at the waist 14, and substantially aligned with the adjacent portion of the sound board edge.

Figure 3:
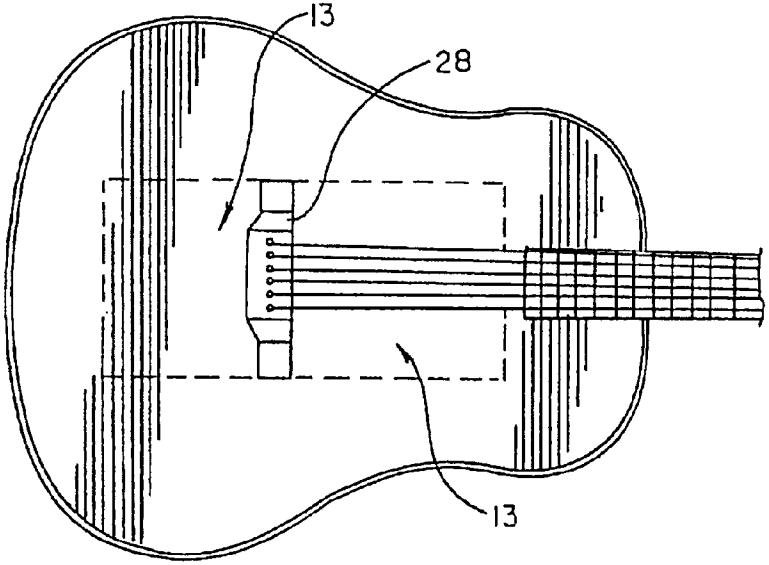
FIG. 3 shows a face view of a guitar illustrating the optimum vibration area of the sound board.

The sound hole positioning in the present invention utilizes more of the sound board which has a greatest capacity for vibration. FIG. 3 illustrates this area 13, which is generally in the center of the sound board. The sound hole is positioned as much above this area as possible, immediately adjacent to the edge 15 of the waist 14. The sound hole may dip down into the area 13 slightly.

The position of the sound hole optimizes the surface area of the sound board while allowing maximum release of sound vibration from within the sound box. Such positioning of the sound hole allows the guitar to sustain longer sound vibration and avoids wave cancellation at lower frequencies.

Figure 6:
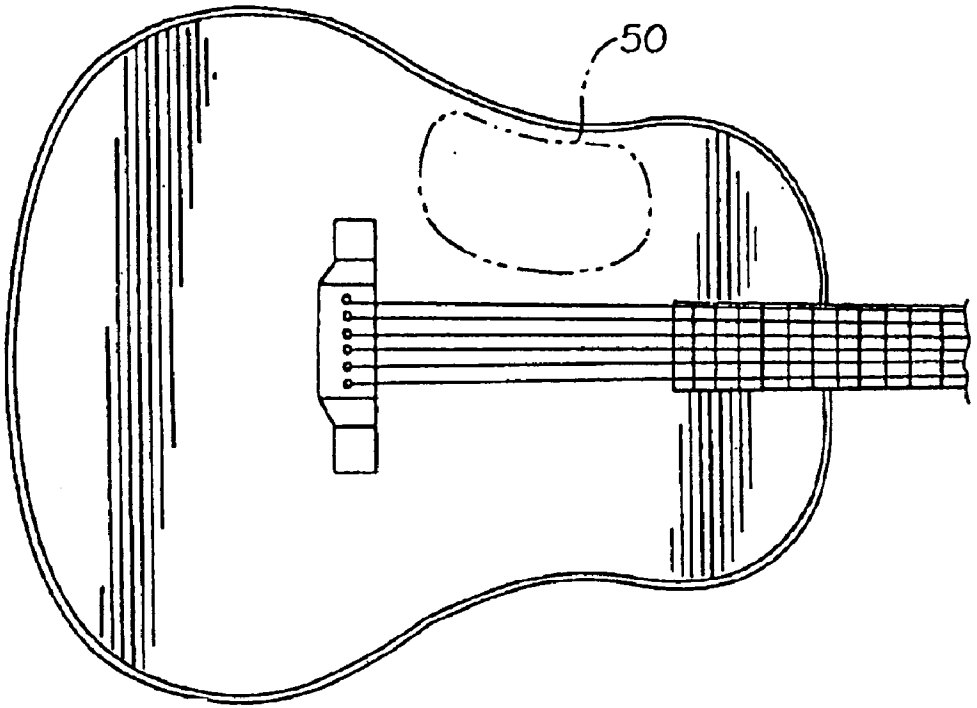
FIG. 6 shows the approximate positioning of the single sound zone.
Figure 7B:
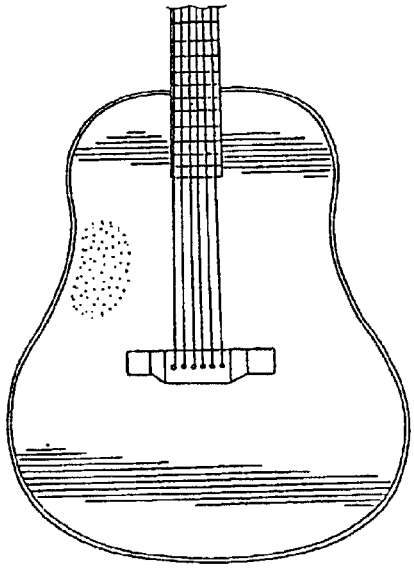
FIGS. 7*a–c* show various hole designs in the sound hole zone.
Figure 7C:
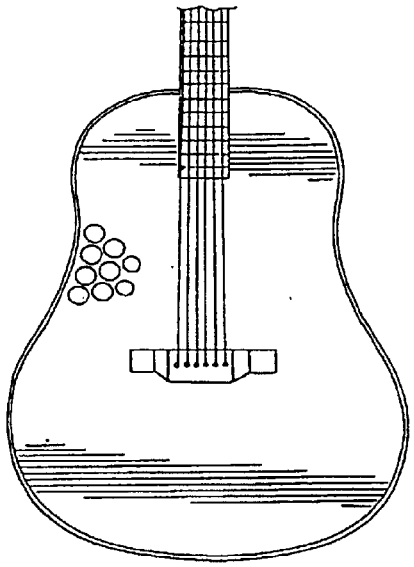
Figure 7A:
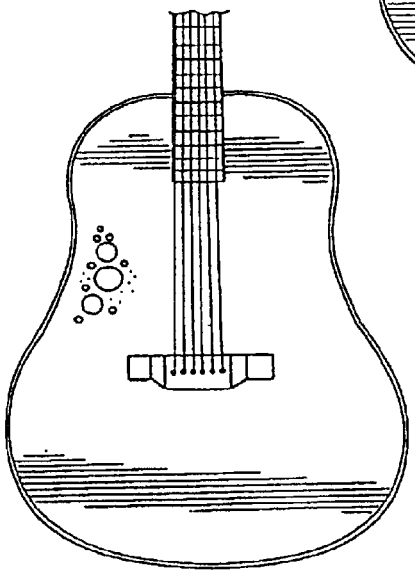

The one sound hole, or zone, may be of alternative configurations or construction. In the alternative to one hole, a plurality of holes, or laser holes, may be made in the specific area, or zone, and covering approximately the same surface area, where said only one sound hole would reside. Preferably, the zone covers approximately 8–16 sq. inches, most preferably about 12 sq. inches, of the sound board. The smaller the zone, the deeper and basier the sound. The larger the zone, the higher the frequency. The general area of this "zone" is illustrated in FIG. 6, and designated as 50. Examples of potential patterns of holes in the sound zone are illustrated in FIGS. 7*a–c*. In FIG. 7*c* the sound hole zone comprises a plurality of pin holes. Additional sound holes in other areas serve only to reduce the surface area of the sound board. While this invention may be embodied in many different forms, there are described in detail herein specific preferred embodiments of the invention. This description is an exemplification of the principles of the invention and is not intended to limit the invention to the particular embodiments illustrated.

In addition to the single sound hole described above, the present invention also includes a novel sound board 22. Typically sound boards comprise a three-ply piece of wood, wherein the separate plies are glued together and laminated on the outer surface. The types of wood and glue that are used for sound boards are well known and need not be discussed further. The three-ply sound boards, due to the three layers of wood and the two layers of glue, have a tendency to sound "dumpy". The present invention employs a solid piece of wood or a two-ply sound board having one glue layer, wherein the grains of the two layers are configured in substantially perpendicular directions. In a two-ply sound board the glue is in the neutral axis with regard to vibration between the two layers of wood. As such, the glue layer is free from significant tension or compression and therefore has very little, as compared to multiple glue lines, effect on the pure vibration of the wood layers. The sound board of the present invention having one solid layer also does not have the dumpy effect found in multiple glue line sound boards.

Figure 5:
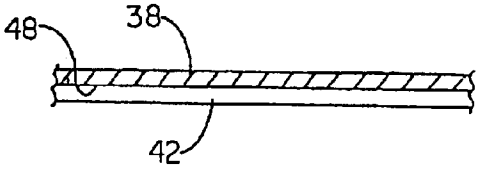
FIG. 5 shows a cross-section of the sound board of FIG. 3.
Figure 4:
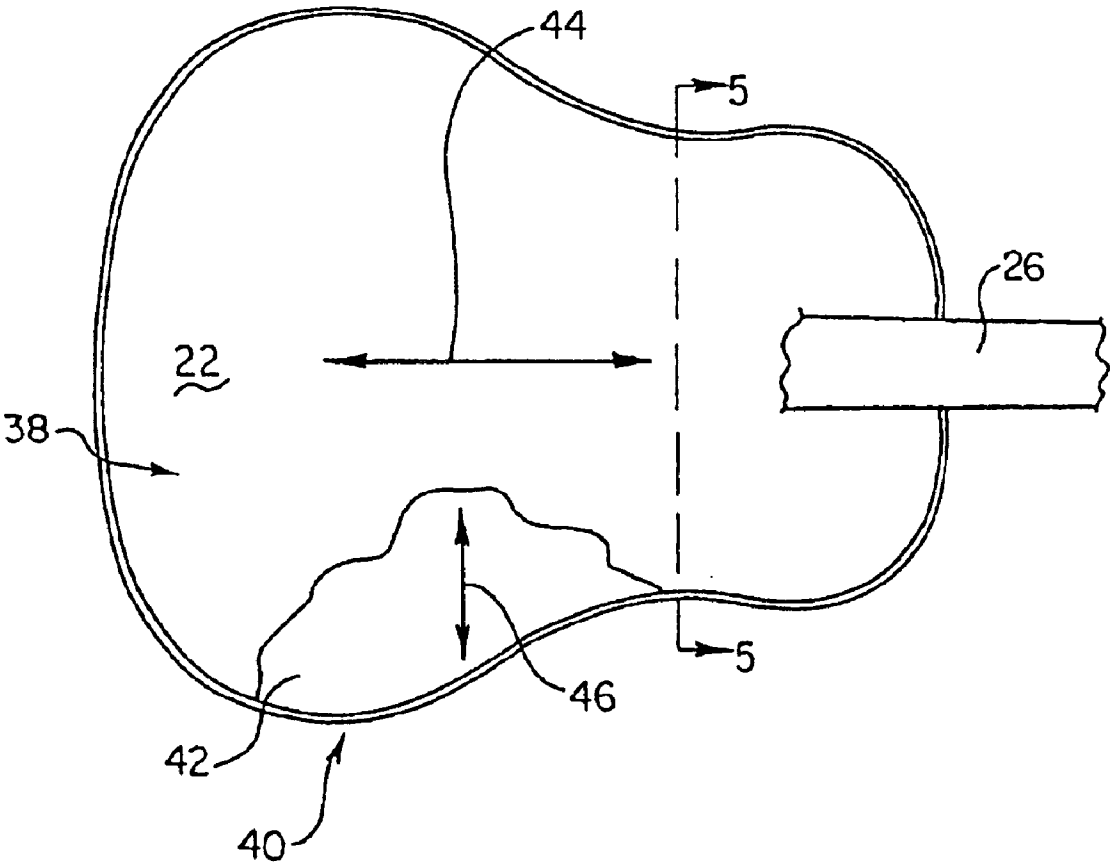
FIG. 4 shows a face view of a sound board with a cut out portion.

FIGS. 4 and 5 illustrate the sound board 22 of the present invention. FIG. 4 (sound hole not shown) illustrates the top layer 38 of the sound board 22 with a cut out portion 40 showing the bottom layer 42 of the sound board. The direction of the grain 44 of the top layer 38 is in the opposite direction to the direction of the grain 46 of the bottom layer 42. The perpendicular grains contribute to the stability of the sound board 22 and to the uniformity of the vibration of the sound board.

FIG. 5 shows a cross-section of the sound board 22, illustrating the top layer 38, the glue line 48 and the bottom layer 42 (the grain of the bottom layer would not be visible in this end view).

The offset placement of the sound hole, or zone, of the present invention allows for optimum vibration of the sound board 22, which occurs in the middle of the sound board 22. In conjunction with the placement of the sound hole, the two-ply sound board provides further optimization of the vibration and sound. The use of only a single layer of wood or two layers of wood and one glue line, wherein the grains of the two layers are perpendicularly arranged, reduces the "dumpy" sound of three-ply boards having two glue lines. The combination of the novel hole configuration and placement combined with the two-ply board of the present invention provides superior sound.

The above examples and disclosure are intended to be illustrative and not exhaustive. These examples and description will suggest many variations and alternatives to one of ordinary skill in this art. All of these alternatives and variations are intended to be included within the scope of the attached claims. Those familiar with the art may recognize other equivalents to the specific embodiments described herein which equivalents are also intended to be encompassed by the claims attached hereto.

What is claimed is as follows:

1. In an acoustic guitar, the guitar having a sound box having a sound board, a neck, a plurality of strings positioned above the sound board, the improvement comprising the sound board comprising no more that two layers of wood bonded together, wherein the grain direction of the two layers of wood are in substantially parallel planes, running in substantially perpendicular directions.

2. The acoustic guitar of claim 1, wherein the two layers are glued together.

3. The acoustic guitar of claim 2, wherein the grain direction of the two layers of wood are in substantially perpendicular directions.

4. The acoustic guitar of claim 2, wherein the sound board is laminated.

5. In a stringed-instrument, the stringed-instrument having a sound box, the sound box having a bottom, a sound board and a plurality of strings positioned above the sound board, the improvement comprising a sound board comprising no more than two layers of wood bonded together, wherein the grain direction of the two layers of wood are in substantially parallel planes, running at an angle equal to or less than 90 degrees relative to one another.

6. The stringed-instrument of claim 5, wherein the grain direction of the two layers run in substantially perpendicular directions.

7. The stringed-instrument of claim 6, wherein the two layers are adhered together.

8. The stringed-instrument of claim 7, wherein the sound board is laminated.

9. The stringed-instrument of claim 5, wherein the stringed-instrument is a guitar.

10. The stringed-instrument of claim 9, the soundboard having an upper and lower bout, the upper and lower bout defining a mutual upper edge, a plurality of strings including bass and treble, positioned above the sound board, and a bridge on the sound board in the lower bout for receiving the strings, the guitar having an arrangement of no more than one sound hole zone in the sound board, said sound hole zone being substantially located between the bridge and the upper bout and between the bass strings and the upper edge of the guitar body sound board.

11. The stringed-instrument of claim 10, wherein the sound hole zone has a plurality of holes.

12. The stringed-instrument of claim 11, wherein the plurality of holes are pin holes.

13. The stringed-instrument of claim 10, wherein the sound hole zone has one hole.

14. The stringed-instrument of claim 13, the guitar having a waist between the upper and lower bout, wherein the hole is located between the waist and bridge.

15. The stringed-instrument of claim 13 wherein the hole is located immediately adjacent to the upper edge of the soundboard at the waist.

16. The stringed-instrument of claim 13 wherein the hole is oriented in the sound board in general alignment with the adjacent sound board upper edge.

17. In a stringed-instrument, the stringed-instrument having a sound box, the sound box having a bottom, a sound board and a plurality of strings positioned above the sound board, the improvement comprising a sound board comprising no more than two layers of wood bonded together, wherein the grain direction of the two layers of wood are in substantially parallel planes, running in a non-parallel fashion relative to one another.

* * * * *